US008065767B2

(12) United States Patent
Gabbai et al.

(10) Patent No.: US 8,065,767 B2
(45) Date of Patent: Nov. 29, 2011

(54) AID FOR THE PREVENTION OF SUDDEN INFANT DEATH SYNDROME

(75) Inventors: Moshe Gabbai, Ashdod (IL); Anatte Gabbai, Ashdod (IL)

(73) Assignee: Moshe Gabbai, Ashdod (IL)

( * ) Notice: Subject to any disclaimer, the term of this patent is extended or adjusted under 35 U.S.C. 154(b) by 0 days.

(21) Appl. No.: 12/087,579

(22) PCT Filed: Jan. 24, 2007

(86) PCT No.: PCT/IL2007/000024
§ 371 (c)(1),
(2), (4) Date: Jul. 10, 2008

(87) PCT Pub. No.: WO2008/068734

PCT Pub. Date: Jun. 12, 2008

(65) Prior Publication Data

US 2009/0249553 A1 Oct. 8, 2009

(30) Foreign Application Priority Data

Dec. 5, 2006 (IL) ..... 179840

(51) Int. Cl.
*A47C 20/04* (2006.01)

(52) U.S. Cl. ..... 5/655; 5/652.1; 5/724; 5/727

(58) Field of Classification Search ..... 5/638, 652.1, 5/655, 655.9, 727, 730, 740, 724–726, 652.2; 297/180.14, 452.42, 452.43; D6/595, 596, D6/601, 605

See application file for complete search history.

(56) References Cited

U.S. PATENT DOCUMENTS

| | | | | |
|---|---|---|---|---|
| 4,866,800 | A * | 9/1989 | Bedford | 5/652.1 |
| 5,226,188 | A * | 7/1993 | Liou | 5/653 |
| 5,261,420 | A * | 11/1993 | Grillo | 5/655.9 |
| 5,566,407 | A * | 10/1996 | Lien | 5/93.1 |
| 6,541,094 | B1 * | 4/2003 | Landvik et al. | 428/71 |
| 7,334,280 | B1 * | 2/2008 | Swartzburg et al. | 5/724 |

* cited by examiner

*Primary Examiner* — Robert G Santos
*Assistant Examiner* — Nicholas Polito

(57) ABSTRACT

The present invention provides a safety apparatus as an aid for the prevention of Sudden Infant Death Syndrome: A mattress, fitting the dimensions of a standard-sized crib, is composed of three different layers, allowing a free flow of air through it to the infant lying in any position. The lowest layer has transverse channels allowing cross-wise air movement. The middle and top layers have vertical perforations through them allowing a vertical flow of air. Being composed of 3 layers, differing in density and firmness, the mattress is both firm and pleasant to the touch. Therefore, in addition to its primary function, the mattress provides a method to counter a potential delay in the motor development of the infant, which can result from prolonged lying in the supine position. A mesh sheet is stretched taut over the mattress and fastened securely to the vertical bars of the crib.

4 Claims, 5 Drawing Sheets

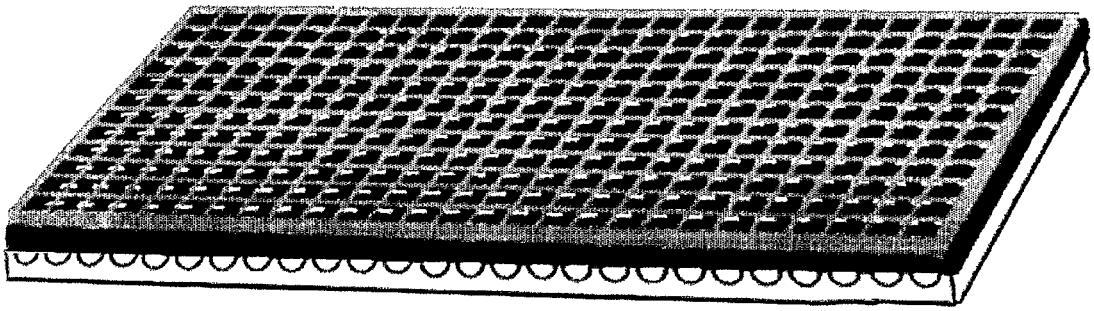
Figure No.1

Figure No. 3
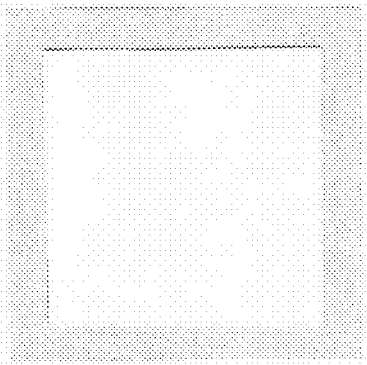
Figure No. 4
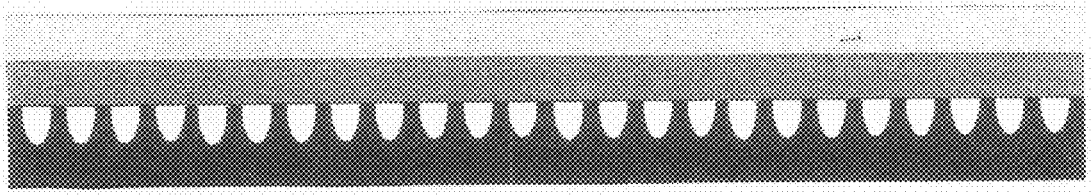

Figure No.5
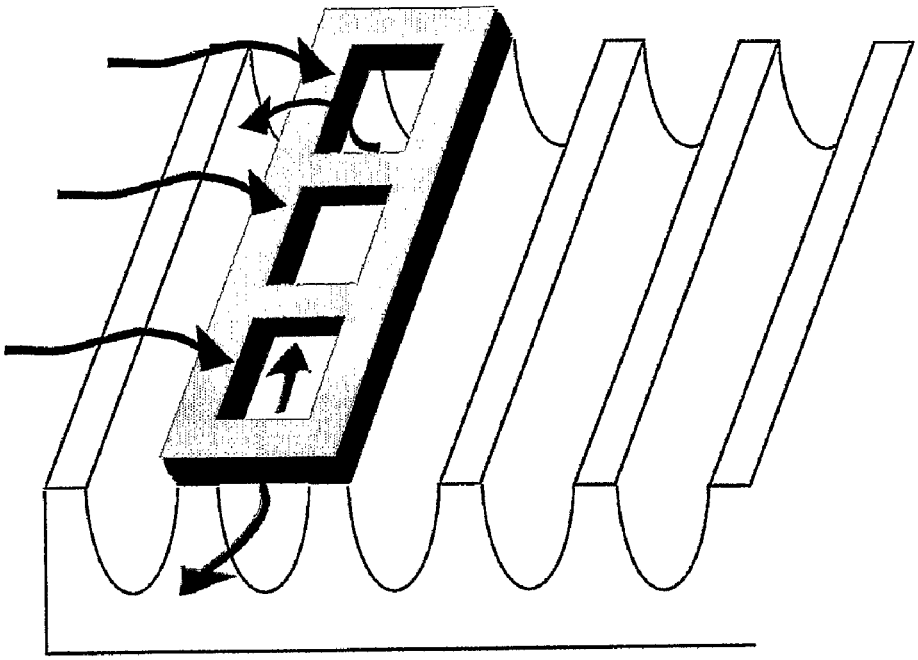
Figure No.6
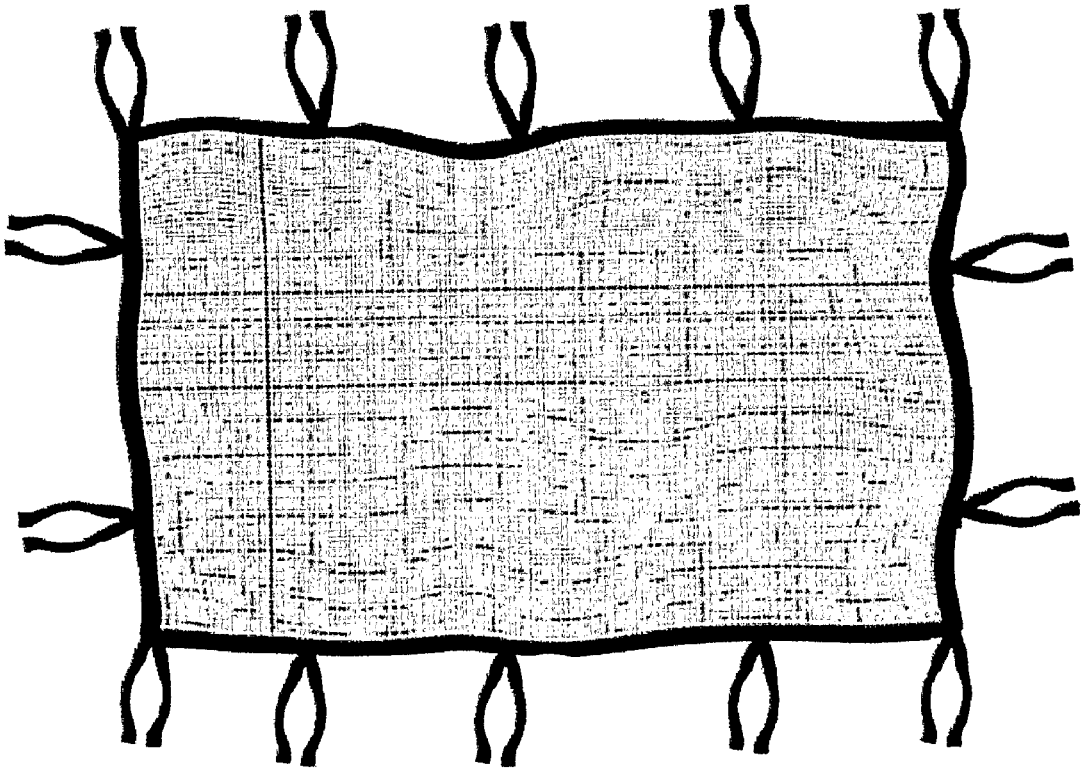

Figure No.7
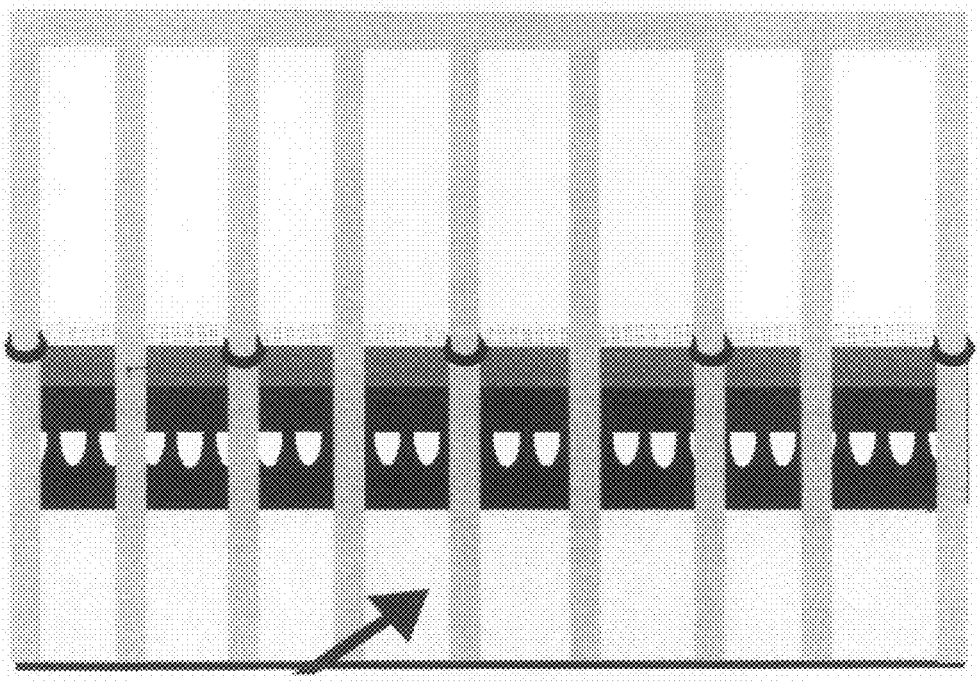

AID FOR THE PREVENTION OF SUDDEN INFANT DEATH SYNDROME

TECHNICAL FIELD

Safety

BACKGROUND

Sudden Infant Death Syndrome (SIDS) has claimed thousands of deaths of infants between the ages of two weeks and one year. In all cases, death occurred while the child was sleeping in the prone position, but the exact cause of death has not been conclusively identified.

However, in a recent article in *JAMA* (The Journal of the American Medical Association, 2006, Vol. 296, No. 17, 2124-2132), a connection was suggested between SIDS deaths and a neurological defect in the brain stem, which prevents the infant, sleeping in the prone position, from reacting normally to a lack in the supply of oxygen. A healthy infant would lift or turn its head in order to breathe. Over the last ten years, a campaign initiated by doctors, nurses and medical journals, which recommended laying the child to sleep on its back, has resulted in a significant drop in SIDS deaths.

Not all parents, however, have been willing to follow these recommendations. They fear that their child will regurgitate part of its food and will suffocate as a result. Besides, by the age of 5-6 months, infants can already turn over by themselves.

In a different approach to the problem of sleep positions, pediatricians have come to the conclusion that infants sleeping in the prone position attain several motor capabilities earlier than supine sleepers. (*Pediatrics*, November, 1998, Vol. 102, 1135-1140).

A lateral search of the relevant SIDS data-bank has revealed one patent dated 1999 (U.S. Pat. No. 5,857,232).

DISCLOSURE OF INVENTION

The present invention addresses the various aspects of the problem. It is based on a perforated mattress which fits inside a standard-sized crib.

This arrangement firmly supports the infant in any position and allows a free flow of fresh air at all times. The mattress is made of the latest innovative, non-toxic materials, available at any degree of elasticity desired, approximating standard crib mattresses. A mesh sheet, allowing free air flow, is stretched taut over the mattress and is fastened to the vertical bars of the crib by means of straps or VELCRO®.

The wide use of innovative synthetic materials for a variety of purposes enables the development and designing of a mattress with the following advantages:

1. A simple and practical solution of the problem under discussion.
2. The mattress gives uniform support, approximating the support of a standard crib mattress. This support counters a potential cause of delayed development of motor capabilities in the child.
3. Being composed of three layers, the mattress is, simultaneously, firm and pleasant to the touch.
4. The mattress may be washed and dried without losing its characteristics.
5. The simple production methods offer the possibility of a relatively inexpensive product.

BRIEF DESCRIPTION OF DRAWINGS

FIG. No. 1: 3-dimensional view of perforated mattress
FIG. No. 2A: Side view of top layer FIG. No. 2B: Side view of middle layer
FIG. No. 2C: Side view of lowest layer
FIG. No. 3: Overhead view of one perforation
FIG. No. 4: Side view of 3 layers of mattress (along the length of mattress)
FIG. No. 5: Illustration of air circulation
FIG. No. 6: Overhead view of mesh sheet
FIG. No. 7: Illustration of fastening the sheet over the mattress to the crib bars

BEST MODE FOR CARRYING OUT THE INVENTION

Figure 2A:
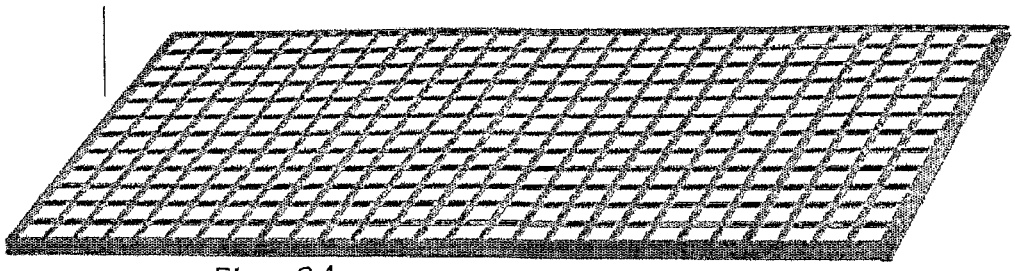
Figure 2B:
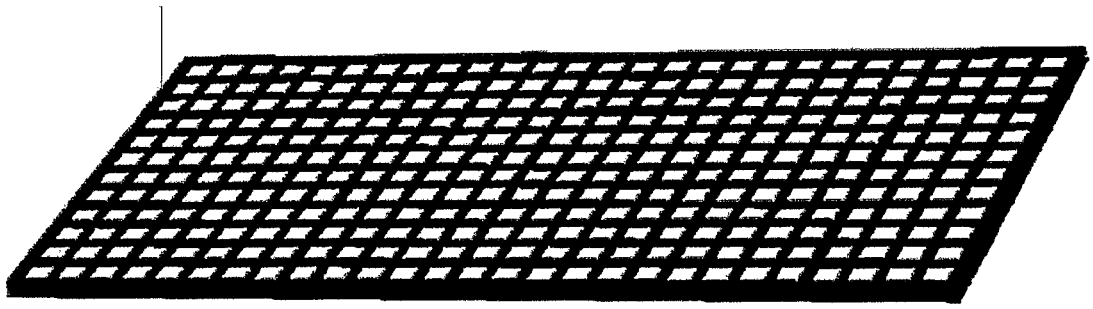
Figure 2C:
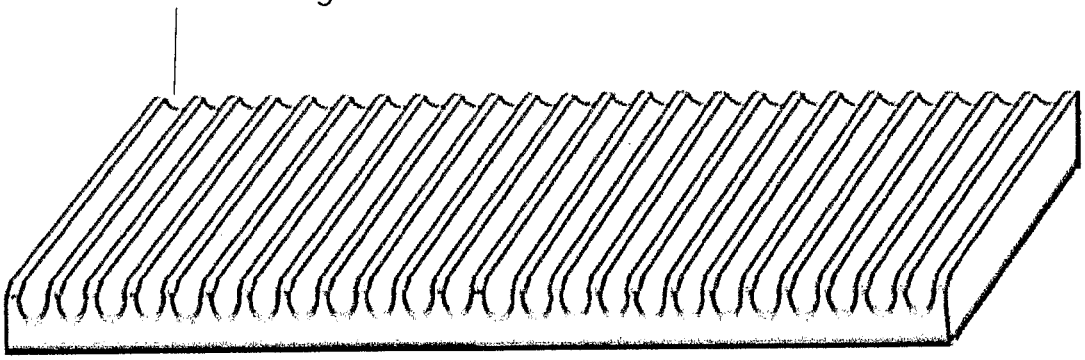

The present invention is made up of 2 parts:

1. A mattress
2. A mesh sheet

The mattress is composed of three layers (FIG. No. 1 and 2A,2B,2C). The lowest layer, which is dense and firm, has transverse channels which allow cross-wise movement of air (FIG. No. 2C). The middle layer, which is similarly dense and firm, is vertically perforated along its entire surface (FIG. No. 2B). These perforations allow a vertical flow of air. The top layer is identical to the middle layer but is soft, flexible, constitutes a comfortable support for the infant and is pleasant to the touch (FIG. No. 2A). The size and shape of the perforations and the spaces between them in the middle and top layers (FIG. No. 3), combined with the transverse channels of the lowest layer, allow a constant flow of air to the infant sleeping in the prone position (FIG. No. 5).

A mesh sheet, allowing free air flow, is stretched taut over the mattress and is fastened to the vertical bars of the crib, on all 4 sides, by means of straps or VELCRO™ (FIG. No. 6 and No. 7).

INDUSTRIAL APPLICATIONS

The mattress is made of non-toxic materials such as cross-linked closed cell polyethelene foam or rubber. In one embodiment of the invention, the material of the mattress is preferably PALFOAM™, manufactured by Palziv, Israel.

PALFOAM™ offers washable materials which have a fine, uniform closed-cell structure with a pleasant texture, which come in varied densities. These materials have high mechanical and elastic stability, wide temperature resistance, high resistance to wear and tear and are compatible with milling (CNC), vacuum-forming, die-cutting and gluing.

The lowest layer of the mattress (FIG. No. 2C) is produced by milling. The two upper layers (FIG. No. 2B and 2A) are produced by die-cutting. All 3 layers are finally glued together.

The sheet is of mesh fabric such as cotton or cotton combined with polyester.

What is claimed:

1. A perforated mattress, as an aid for preventing SIDS death, in the dimensions to fit a standard crib, is composed of 3 glued together layers, on which an air-permeable mesh sheet is stretched taut; the lowest layer, which is dense and firm, has a plurality of parallel transverse channels each having a U-shaped vertical cross section which allow cross-wise movement of air; the middle layer, which is similarly dense and firm, is vertically perforated along its entire surface with an array of square openings extending from a top surface to a bottom surface of the middle layer to allow a vertical flow of air, the width of the openings aligned with and matching the width of the channels; the top layer is identical to the middle layer but is soft, flexible and constitutes a comfortable support to the infant.

2. The mattress as defined in claim 1, is made of cross-linked closed-cell polyethylene foam or rubber.

3. The sheet as defined in claim 1, is made of cotton or cotton combined with polyester.

4. The perforated mattress and the air-permeable mesh sheet as defined in claim 1, allow a free flow of air to the infant lying in any position in the crib.

* * * * *